US005566604A

United States Patent [19]

Sperling et al.

[11] Patent Number: 5,566,604

[45] Date of Patent: Oct. 22, 1996

[54] APPARATUS FOR EXTRACTING A FLEXIBLE PRODUCT FROM A MACHINE FOR FABRICATING SAME

[75] Inventors: Werner Sperling, Dellingsen; Jürgen Lührig, Alfeld, both of Germany

[73] Assignee: Spirka Maschinenbau GmbH & Co. KG, Alfeld (Leine), Germany

[21] Appl. No.: 347,655

[22] Filed: Nov. 30, 1994

[30] Foreign Application Priority Data

Dec. 13, 1993 [DE] Germany ..... 9319096 U

[51] Int. Cl.[6] ..... D04C 3/38

[52] U.S. Cl. ..... 87/31; 66/149 R; 66/204; 66/210

[58] Field of Search ..... 87/20, 19, 31, 87/61, 11; 57/264, 93, 100; 66/210, 147, 149 R, 152, 153, 82 A, 204

[56] References Cited

U.S. PATENT DOCUMENTS

| | | | |
|---|---|---|---|
| 3,943,689 | 3/1976 | Kunz et al. | 57/264 |
| 4,266,461 | 5/1981 | Molitors | 87/20 X |
| 4,371,823 | 2/1983 | Lohest . | |
| 4,430,870 | 2/1984 | Winter et al. | 66/210 |
| 4,605,044 | 8/1986 | Sakano | 66/210 X |
| 4,922,798 | 5/1990 | Ivsan et al. | 87/11 X |
| 5,157,949 | 10/1992 | Sawazaki et al. | 66/153 X |
| 5,237,805 | 8/1993 | Menegatto | 57/264 X |
| 5,398,586 | 3/1995 | Akiyama et al. | 47/11 X |
| 5,400,582 | 3/1995 | Hartmeier et al. | 57/264 |
| 5,417,138 | 5/1995 | Morris et al. | 87/31 |

FOREIGN PATENT DOCUMENTS 33 13 500 1/1984 Germany .

*Primary Examiner*—Joseph J. Hail, III
*Attorney, Agent, or Firm*—Herbert Dubno

[57] ABSTRACT

A machine for producing braid or circular knit fabric has a withdrawal unit for the continuous product driven by a synchronous motor receiving its drive signal from a digital frequency converter. A pulse generator connected with the main motor of the machine produces pulses representing the speed of the main motor which are integrated and applied to a multiplier introducing the proportionality factor between the main drive and the withdrawal drive. That multiplier has an output which is applied as the input to the digital frequency converter.

7 Claims, 2 Drawing Sheets

APPARATUS FOR EXTRACTING A FLEXIBLE PRODUCT FROM A MACHINE FOR FABRICATING SAME

FIELD OF THE INVENTION

Our present invention relates to an apparatus or device for withdrawing a flexible product from a machine for fabricating such a product. More particularly, the invention relates to the extraction of a flexible elongated product from a fabricating machine, especially a machine for producing braid, circular knit fabric or the like having a withdrawal drive whose speed is in proportion to the speed of a main drive of the fabricating machine and, especially, where a control frequency is influenced or determined by the speed of the main drive of the fabricating machine and, in turn, regulates the speed of the withdrawal drive. The invention relates to a system of this type in which one of the control frequencies or a synchronization parameter derived therefrom can be varied in conjunction with the withdrawal of the elongated product from the fabricating machine.

BACKGROUND OF THE INVENTION

Generally a braiding machine can have spools with thread, yarn or wire mounted upon a rotor which is driven about a common axis, namely, an axis of rotation of the rotor by a main drive via a transmission. As a consequence of the rotation of the rotor, the elements from the spools are entrained about the axis or are wound on a flexible core to form the braid, some of the spools being movable in the opposite direction and, via an appropriate mechanism, these yarns, threads or wires are brought under or over the elements from other spools to form the braid.

The result is a flexible product, namely, the braid which is withdrawn from the machine by an extracting or withdrawal drive which can have a disk over which the elongated flexible product is carried out of the machine and, if desired, wound up.

The withdrawal speed of the elongated product must be exactly matched to the speed of the aforementioned rotor so that the yarns will have the desired orientation and pitch in the product and, in general, product quality will not vary over the length thereof.

It is generally known to provide a device for withdrawing flexible elongated product from such machines by providing a control frequency which is determined by the speed of the main drive operating the withdrawal drive with this frequency or a frequency or signal derived from the control signal, and to control the latter frequency or the parameter.

In such systems, the speed of the withdrawal drive can be influenced or dependent upon the speed of the main drive. The influence upon the speed of the withdrawal drive is based upon the control frequency generated by the main drive and which, in turn, can be influenced in its origin since it permits the desired proportionality between the withdrawal speed and the main drive speed which affects the quality and character of the flexible product. Should the main drive speed increase, the withdrawal speed drive speed will increase in the fixed proportion and should the main drive speed diminish, the speed of the withdrawal drive will diminish in the fixed proportion. The pitch of the yarn, threads or wires in the braid will thus remain constant over the entire manufacturing process and the quality of the product will not fluctuate with variations in speed.

An unregulated asynchronous motor can be used for the main drive since its speed variations are always translated into proportional variations in the speed of the withdrawal drive. The coupling between the two drives, although electronic, thus merely replaces the fixed ratio mechanism transmissions between the main drive and withdrawal drive which previously were used.

In the withdrawal of a flexible product from a fabricating machine, care must be taken to avoid the development of flaws in the product which may result from a defect in fabrication. For example, it is conceivable that a thread breakage will occur. In such a case, the particular thread is no longer withdrawn but can be wound up in an unbraided fashion resulting in a thickening in the product. The thickening can result in a hang-up of the product to a greater or lesser extent and thus to greater defects in the product, overloading of the withdrawal drive, the development of excessive tension in the product, etc. For this reason in conventional braiding machines in the transmission system between the main drive and the withdrawal drive shearing pins or toothed shearing wheels of plastic can be provided for automatic mechanical interruption of the link between the fabricating machine to the withdrawal device when such difficulties occur, thereby preventing damage to the rotor, overloading of the withdrawal drive, etc.

If the withdrawal drive is not mechanically coupled to the main drive but is connected thereto via an electrical path with a servodrive, such overloading conditions can be compensated electronically.

The electrical systems used heretofore, however, are complex and expensive and the regulatory devices necessary to prevent overloading are also expensive to provide and operate and may not always be reliable.

OBJECTS OF THE INVENTION

It is, therefore, the principal object of the present invention to provide an apparatus which allows adjustable proportional synchronization between the speeds of the main drive and the withdrawal drive by simple means.

Another object of the invention is to provide an improved apparatus for withdrawing a flexible product from a machine producing same, having a main drive and a withdrawal drive, especially braid and circular knit products, whereby the advantages of earlier electrical control systems can be obtained without the drawbacks previously mentioned.

It is yet another object of the invention to provide an improved low-cost control system for the withdrawal and main drives of a machine for producing a braid or circular knit product.

SUMMARY OF THE INVENTION

These objects are attained, in accordance with the invention, by providing the withdrawal drive as a synchronous motor whose speed is controlled by a frequency derived from the control frequency of the main drive of the machine for a digital frequency converter.

For the invention, it is important that the withdrawal drive utilize a controlled synchronous motor at the input side of which a frequency converter is provided. The speed of the withdrawal drive is determined by the speed of the main drive without any need for feed-back control. More particularly, the synchronous motor is controlled by a digital frequency converter receiving as the input, the control frequency derived from the main drive or a synchronizing parameter corresponding thereto. The digital frequency converter provides an output frequency which corresponds exactly to the input signal or parameter in a manner which cannot be obtained with analog frequency conversion since, in such cases, temperature and other effects upon the converter characteristic require feed-back control to exclude them in response to variations in the output parameter. Such feed-back control which may require a servosystem also is a key to the high costs which are eliminated with the present invention. Furthermore, a synchronous motor is far less costly than a servosystem so that the advantages of the present invention are gained together with an economic advantage.

The maximum required withdrawal torque stipulated for the withdrawal device, can be smaller than that which would correspond to the nominal speed of the synchronous motor at the stipulated control frequency. In other words, the synchronous motor is overdimensioned with respect to the requirements. This does not create an economic disadvantage since the synchronous motors which are used are employed in a power range of about 0.25 to 0.75 kW and in this power range, there is little price difference.

According to a feature of the invention the device for reliable operation is so configured that the maximum control frequency, for the stipulated maximum speed of the synchronous motor is tuned or reconciled to the orderly operation of the synchronous drive. Here too the additional dimensional consideration for the synchronous motor does not give rise to any significant increase in cost.

According to a feature of the invention, for generating the control frequency, the main drive is provided with an incrementally operating rotary pulse generator whose output is connected to the input of an integrator for producing digital signals representing the angular position of the main drive. The signals produced by the pulse generator cannot be directly utilized as an input to the digital frequency convertor. As a consequence, the integrator is provided to transform the output from the pulse generator into digital signals representing the angular displacement of the drive which can serve as the input to the digital frequency converter.

To achieve the desired proportional synchronization between the speeds of the main drive and of the withdrawal drive, according to the invention, the digital integrator output is connected to the input of a multiplier introducing the proportionality factor. The output is the digital synchronization signal which is applied to the digital frequency converter. To close the chain between the main drive and the withdrawal drive, the apparatus of the present invention applies alternating output of the digital frequency converter to the synchronous motor of the withdrawal drive. This output is thus the synchronizing alternating current frequency.

In an apparatus for withdrawing flexible product like braid or circular knit fabric, it cannot be precluded that a failure at the fabricating machine may cause disruption of the operation. The sensitivity of the synchronous motor with respect to overload can be utilized in accordance with the invention to avoid significant failures because the synchronous motor rapidly switches to standstill before excessive forces become effective at it. As a consequence, it is advantageous to provide the apparatus with an alarm or failure indicator for the synchronous motor which responds to the tipping thereof into an ineffective state and/or to standstill. With the aid of this failure indication or alarm signal transmission, the operating personnel can be readily notified of the failure and can take appropriate steps to restore the apparatus to operation. The monitoring device can automatically cut off the machine if desired.

The apparatus of the present invention thus can comprise:

a machine drive;

means connected with the machine drive for deriving a control frequency representing a speed of the machine drive;

a product-withdrawal mechanism on the machine for withdrawing the product at a speed determined to maintain a quality of the product;

a synchronous motor operatively connected with the mechanism for driving same at the speed determined to maintain the quality of the product; and a digital frequency converter responsive to the control frequency and connected to the synchronous motor for controlling the synchronous motor to operate the synchronous motor at a speed proportional to the speed of the machine drive.

The machine drive can have a machine drive motor which can be connected to the rotor carrying the spools for a machine fabricating the flexible braid or circular knit as the product. According to the invention the synchronous motor is dimensioned for a predetermined maximum require withdrawal torque of the withdrawal mechanism which is less than a torque corresponding to a nominal power of the synchronous motor at the control frequency.

The motors can be dimensioned so that the control frequency has a maximum value in consonance with a predetermined maximum speed of the synchronous motor for operation of the mechanism.

The means connected with the machine drive for deriving the control frequency can be an incremental pulse generator connected to the machine drive, and a digital integrator having an input connected to an output of the pulse generator for generating a digital value representing angular displacement of the machine drive, the integrator having an output operatively connected with the digital frequency converter.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
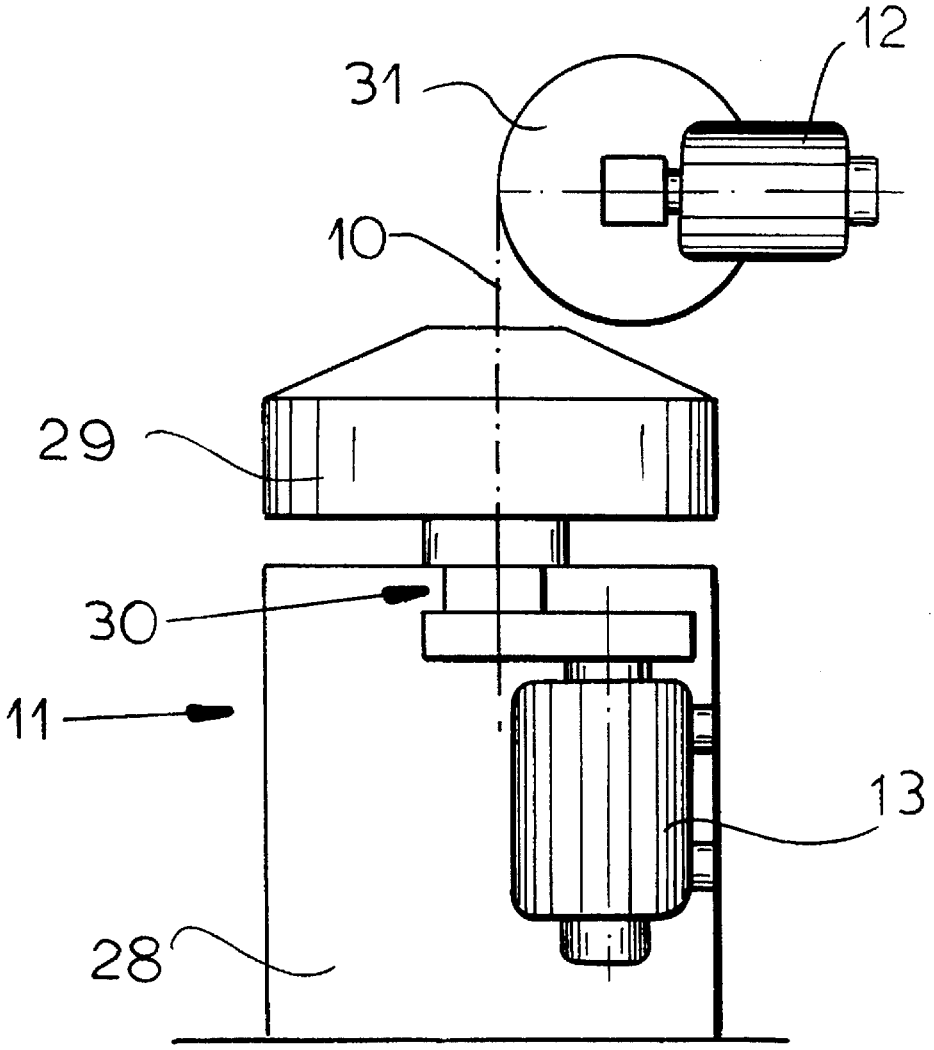
FIG. 1 is a diagrammatic side elevational view of a braid-producing machine.

FIG. 1 shows a machine 11 for producing an elongated product, especially a braid-producing machine, having a machine frame 28 on which a rotor 29 is mounted for rotation about a vertical axis. The rotor 29 can carry 16 spools or bobbins (not shown) which produce a continuous flexible braid as the rotor 29 is rotated. Between the main drive 13 and the rotor 29, a transmission 30 is provided with a transmission ratio of, for example 1:8 to 1:10. The main drive can have a power of about 2.2 to 3 kW.

With the aid of the rotor 29, the flexible product 10 is produced, i.e. in the form of a continuous braid, which is withdrawn from the machine over a withdrawal disk 31 and can be wound up. To drive the withdrawal disk 31, we provide a withdrawal drive 12, i.e. a motor and transmission unit whose motor 15 (FIG. 2) is a synchronous motor with a power of about 0.37 kW and which drives the withdrawal disk 31 with a transmission ratio of 1:50 to 1:100, the speed reduction between the motor and the disk being in this ratio.

Figure 2:
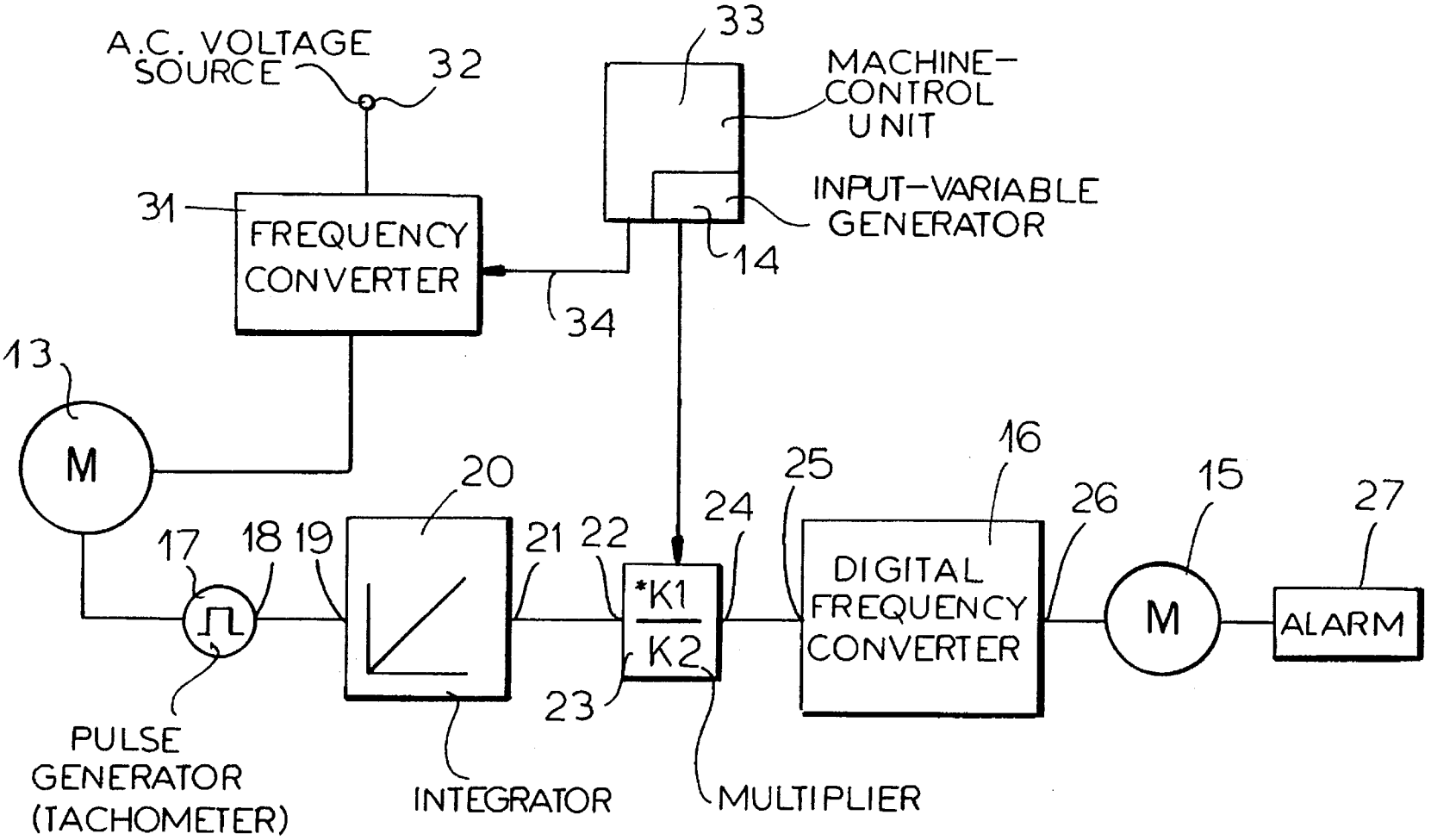
FIG. 2 is a block diagram of the important elements of the circuitry of the invention.

As can be seen from FIG. 2, the motor 13 of the main drive may be controlled by a frequency converter 31 from the line voltage source 32, the frequency converter 31 controlling the speed of the motor 13 from a machine control unit 33 which supplies an input schematically represented at 34 to the frequency converter 31 to turn on or turn off the main drive.

To control the synchronous motor 15 of the withdrawal unit in proportional synchronization with the main drive 13, so that the continuous braid 10 will have a constant quality, the speeds of the motors 15 and 13 are proportionally synchronized.

For this purpose, the main drive 13 has a rotary pulse generator 17 connected thereto which incrementally produces pulses corresponding to the speed of the main motor 13 and has a control frequency f. This control frequency can be in the 400 kHz range when, for example, the rotary pulse generator produces 4000 pulses per rotation and is driven at about 100 revolutions per minute via the transmission of the motor 13.

The output 18 of the rotary pulse generator 17 is connected to the input 19 of an integrator 20 which in accordance with its characteristic, outputs at 21 a digital signal representing the angular displacement of the main drive 13.

This derived synchronization signal must operate the motor 15, not with the same speed as the motor 13, but with a proportionally reduced speed, namely, the withdrawal speed as determined by the proportionality factor $K_1/K_2$. $K_2$ can be a constant factor determined by the construction of the machine 11 and the withdrawal drive 12, while $K_1$ is a factor determined by the structure of the elongated product 10 and will differ from product to product fabricated by the machine.

The output 21 of the integrator 20 is thus multiplied by the proportionality factor $K_1/K_2$ and for that purpose is applied to the input 22 of a multiplier 23 at the output of which a digital frequency converter 16 is connected. The input variable generator 14 of the machine control unit 33 applies the factor $K_1$ to the multiplier 23.

The digital frequency converter 16 has an alternating current output at 26 which is applied to the synchronous motor 15. The digital frequency converter 16 converts the digital input from the multiplier 23 into the requisite frequency for driving the synchronous motor. The frequency converter 16 is preferably a three-phase completely digital pulse frequency converter which forms from the digital input value a frequency for synchronously operating the motor 15 without the influence of temperature and voltage fluctuation, based upon the control frequency f and the synchronous factor and without any need for feed-back control of the synchronous motor.

In order to ensure that the synchronous motor will be operative in regular drive of the withdrawal unit in all operating conditions of the machine 2, it should be overdimensioned. For example, its output torque should be at least the maximum under its nominal power for the perspective operation even at the maximum possible control frequency f. Further, the maximum control frequency should be matched to the maximum speed of the synchronous motor to be required to ensure a reliable and regular synchronous operation, so that even at a maximum speed of the synchronous motor, the capacity of the latter will not be overstepped.

Since defects in the operation of the machine 11 can occur which could place loads upon the withdrawal device greater than the capacity of the synchronous motor to withstand such overloading, the synchronous motor will rapidly fall out of step and tip into an inoperative state. This state can be used for monitoring purposes and to that end, an alarm 27 or failure indicator or signaller is, connected to the synchronous motor to signal to the operator that the synchronous motor 15 has tipped into an inoperative mode and is no longer able to keep up with the synchronous signal applied or has been brought to standstill.

By way of example, for a braiding machine braiding 16 wire strands into a cable with a spool carrier having 16 spools and with an individual strand tension of 30 Newtons (N), the requisite maximum force F=16×30N=480N. The braid is formed with a pitch of 90 mm, i.e. the pitch per rotation of the braiding machine which rotates at 150 revolutions per minute, yielding a withdrawal rate of 150 rpm×0.09 m=13.5 m/min, the rate at which the braid is withdrawn from the machine. If the braid is drawn over a disk with a diameter of 500 mm and a radius of 0.25 m, the disk torque is given by Mt=F×r=480N×0.25 m =120 Nm. The latter is the required disk torque and if one adds a 20% margin for overload protection, the requisite disk torque is given by 144.00 Nm.

The speed of the disk is determined by the ratio $i=v/(\pi d)$ where v is the speed of withdrawal of the braid or 13.5 m/min, d is the disk diameter or 0.5 m. i is thus 8.5944 rpm.

Using a synchronous motor with its nominal speed n=1500 rpm at 50 Hz, the ratio of the speed of the motor to the speed of the disk is 1500/8.5944 or 174.5329. This gives a requisite torque of the synchronous motor of 144 Nm/174.5329 of 0.8250 Nm. The nominal power of that motor is 731 watts.

We claim:

1. An apparatus for withdrawing a flexible product from a machine for fabricating said product, said apparatus comprising:

a machine drive;

means connected with said machine drive for deriving a control frequency representing a speed of said machine drive;

a product-withdrawal mechanism on said machine for withdrawing said product at a speed determined to maintain a quality of said product;

a synchronous motor operatively connected with said mechanism for driving same at said speed determined to maintain said quality of said product; and a digital frequency converter responsive to said control frequency and connected to said synchronous motor for controlling said synchronous motor to operate said synchronous motor at a speed proportional to said speed of said machine drive, said means connected with said machine drive for deriving a control frequency representing a speed of said machine drive being an incrementally effective pulse generator connected to said machine drive, and a digital integrator having an input connected to an output of said pulse generator for generating a digital value representing angular displacement of said machine drive, said integrator having an output operatively connected with said digital frequency converter.

2. The apparatus defined in claim 1 wherein said machine drive has a machine drive motor and said machine is a machine for fabricating a flexible braid or circular knit as said product.

3. The apparatus defined in claim 2 wherein said synchronous motor has an available torque greater than a maximum required withdrawal torque of said withdrawal mechanism.

4. The apparatus defined in claim 3 wherein said motors are dimensioned so that said control frequency has a maximum value in consonance with a predetermined maximum speed of the synchronous motor for operation of said mechanism.

5. The apparatus defined in claim 1 wherein said output of said integrator is connected to an input of a multiplier introducing a proportionality factor as a multiplier for said digital value representing angular displacement before applying said digital value to said digital frequency converter.

6. The apparatus defined in claim 5 wherein said multiplier has an output connected to an input of said digital frequency converter and said frequency converter has an alternating current output which is applied to said synchronous motor.

7. The apparatus defined in claim 5, further comprising an error indicating or alarm device connected to said synchronous motor for signalling a failure thereof.

* * * * *